US006427019B1

(12) United States Patent
Ketterer et al.

(10) Patent No.: US 6,427,019 B1
(45) Date of Patent: Jul. 30, 2002

(54) SPEAKER ASSEMBLY

(75) Inventors: Ernest Ketterer, Lincoln Park; Anthony Farinaro, Park Ridge, both of NJ (US); William Kieltyka, Brunswick, ME (US)

(73) Assignee: Bogen Communications, Inc., Ramsay, NJ (US)

( * ) Notice: Subject to any disclaimer, the term of this patent is extended or adjusted under 35 U.S.C. 154(b) by 0 days.

(21) Appl. No.: 09/484,408

(22) Filed: Jan. 14, 2000

(51) Int. Cl.[7] ..... H04R 25/00

(52) U.S. Cl. ..... 381/386; 381/152; 181/150; 181/199; 439/77; 439/666

(58) Field of Search ..... 381/386, 398, 381/387, 388, 389, 390, 393, 394, 395, 189, 152, 87; 181/150, 199; 439/77, 660

(56) References Cited

U.S. PATENT DOCUMENTS

| | | | | | |
|---|---|---|---|---|---|
| 1,586,279 | A | | 5/1926 | Batchelder et al. | |
| 1,958,888 | A | | 5/1934 | Cromartie | |
| 2,616,985 | A | | 11/1952 | Levy | |
| 3,737,647 | A | | 6/1973 | Gomi | |
| 3,864,531 | A | | 2/1975 | Watson | |
| 3,866,035 | A | | 2/1975 | Richey, Jr. | |
| 4,161,995 | A | * | 7/1979 | Pohlmann et al. | 181/150 |
| 4,237,525 | A | | 12/1980 | Deter | |
| 4,410,772 | A | | 10/1983 | Sato | |
| 4,516,090 | A | | 5/1985 | Kambara et al. | |
| 4,623,206 | A | | 11/1986 | Fuller | |
| 4,727,587 | A | | 2/1988 | Black | |
| 4,752,962 | A | | 6/1988 | Thiele et al. | |
| 4,972,389 | A | | 11/1990 | Teel | |
| 4,993,510 | A | * | 2/1991 | Kato et al. | 181/150 |
| 5,140,840 | A | | 8/1992 | Miceli | |
| 5,206,464 | A | * | 4/1993 | Lamm et al. | 181/150 |
| 5,535,285 | A | * | 7/1996 | Jwo | 381/188 |
| 5,828,765 | A | * | 10/1998 | Gable | 381/152 |
| 5,859,917 | A | * | 1/1999 | Silber et al. | 381/386 |
| 5,937,073 | A | * | 8/1999 | Van Gieson | 381/386 |
| 6,101,262 | A | * | 8/2000 | Haase et al. | 381/386 |
| 6,257,903 | B1 | * | 7/2001 | Hughson et al. | 439/77 |

OTHER PUBLICATIONS

Lucent Technologies Owner's Manual (May 1997) Issue 6 Installation Instructions.

* cited by examiner

*Primary Examiner*—Huyen Le
*Assistant Examiner*—Suhan Ni
(74) *Attorney, Agent, or Firm*—Collard & Roe, P.C.

(57) ABSTRACT

A speaker assembly comprising a speaker housing, a speaker mounted in the housing, and at least two threaded studs connected to the housing and speaker and extending away from the external surface of the housing. The studs have an unthreaded, pointed end that is particularly suitable for piercing a ceiling tile with little effort or mess. There are at least two nuts for threading over the studs to secure the studs to a ceiling tile after the studs pierce the tile to attach the housing to the tile, and at least two wire nuts to connect amplifier wires to the tip of the studs. The speaker is mounted to a ceiling tile by piercing the tile with the studs and securing the studs to the other side of the tile with the nuts. The amplifier wires are then connected to the tips of the studs via the wire nuts.

9 Claims, 2 Drawing Sheets

SPEAKER ASSEMBLY

BACKGROUND OF THE INVENTION

1. Field of the Invention

The present invention relates to a ceiling-mounted speaker assembly. In particular, the present invention relates to a mounting assembly that accomplishes the mounting quickly and easily without the need for special tools.

2. The Prior Art

Ceiling mounted speakers are common, in which the speakers are mounted to a ceiling panel and have the electrical components connected through wiring above the ceiling panel. Traditionally, the speakers are mounted by cutting a circular hole within which the speaker is attached. This mounting arrangement requires the labor of cutting the hole, and produces dust and debris.

An improvement over the prior methods has been proposed by U.S. Pat. No. 4,727,587 to Black. Black discloses an acoustical transducer mounting arrangement having two elongated posts extending up from the back of the speaker and electrically connected to the terminals of the speaker. The speaker is mounted by piercing the ceiling tile with the posts and securing the posts to the ceiling tile via removable clips. The clips establish an electrical connection between the power source and the speaker.

While this device has prevented the accumulation of dust, it does not mount securely does not have any means of polarity identification and is unreliable because of the numerous electrical contacts required to establish an electrical connection to the speaker.

SUMMARY OF THE INVENTION

It is therefore an object of the present invention to provide a mounting assembly for a speaker that can be mounted to a ceiling tile without damaging the ceiling tile.

It is another object of the present invention to provide a mounting assembly that is easy to use and inexpensive to manufacture.

These and other objects of the invention are accomplished by a speaker assembly comprising a speaker housing having an external surface and an internal surface, and at least two threaded studs connected to the housing and extending away from the external surface of the housing. The studs are electrically connected to a speaker that is mounted within the housing. The studs have an unthreaded, pointed end that is particularly suitable for piercing a ceiling tile with little effort or mess. The tips of the studs are also particularly suited to accommodate wire nuts. This way, speaker wires can be connected to the stud tips via wire nuts that are screwed directly onto the stud tips. There are also at least two nuts for threading over the studs to secure the studs to a ceiling tile after the studs pierce the tile to attach the housing to the tile. The speaker is mounted to a ceiling tile by piercing the tile with the studs and securing the studs to the other side of the tile with the nuts. The speaker wires are then connected to the tips of the studs via the wire nuts.

The nuts attaching the studs to the ceiling tile are preferably wing nuts, and most preferably wide-bottom wing nuts. The use of a wide bottom wing nut and a threaded stud is an improvement over the prior art because using a threaded stud allows the speaker to be drawn up tightly against the mounting surface, which provides for better sound quality, appearance and security. The wing nuts secure the speaker to the ceiling tile better than the clips disclosed in the prior art. In the prior art, the tightness of the mounting between the speaker assembly and the ceiling tile is directly related to how strongly the clips can be pushed against the ceiling tile. In contrast, the present invention easily achieves a strong mount via the wing nuts. In addition, the wing nuts distribute the speaker mounting force over a wider area than the clips of the prior art, allowing tighter mounting of the speaker to the mounting surface, which improves sound quality and performance.

The speaker preferably has an O-ring mounted around an edge of the housing, so that pressing the housing against a ceiling tile causes the O-ring to create a tight seal between the housing and ceiling tile. This eliminates whistles and ensures a smooth sound.

To identify polarity, the studs are separately identifiable, for example, color coded: In one embodiment, one stud is nickel-plated and one stud is copper-plated. Alternatively, any other type of identifying method could be used, such as plating with other metals, making the studs different length, painted markers, etc. This is also an improvement over the prior devices, because since the speaker itself and its internal wiring are obstructed by the mounting surface once it is secured in place, it is difficult to be certain of the polarity of the speaker connection and therefore its phasing in the speaker system. Proper phasing of the speakers in a speaker system is important for sound quality.

The studs have an unthreaded tip to facilitate piercing of the ceiling tile and securing of the wire via the wire nut. The unthreaded tip makes piercing the ceiling tile very clean and easy. The tip is preferably textured to grip the wire nut more securely. Preferably, a knurled pattern is used to provide a more textured surface that aggressively engages the wire nut's internal spiraled threads providing a more secure mechanical connection.

The present invention is an improvement over the prior devices in that it requires only a single connection between the speaker wires and the speaker apparatus. In the patent discussed above, three electrical connections are required to make a connection with the stud, since the clip requires a pig tail wire to connect to the speaker wires. One connection is from the amplifier lead-in wire to the clip's pig tail wires, another is from the pig tail wire to the clip, and the third is from the clip itself to the speaker's stud. This can lead to poor connections and breakage. With the present invention, the only connection is from the amplifier lead-in wires directly to the stud. This improves the audio system's reliability and electrical integrity by reducing the number of electrical connections required for each speaker.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
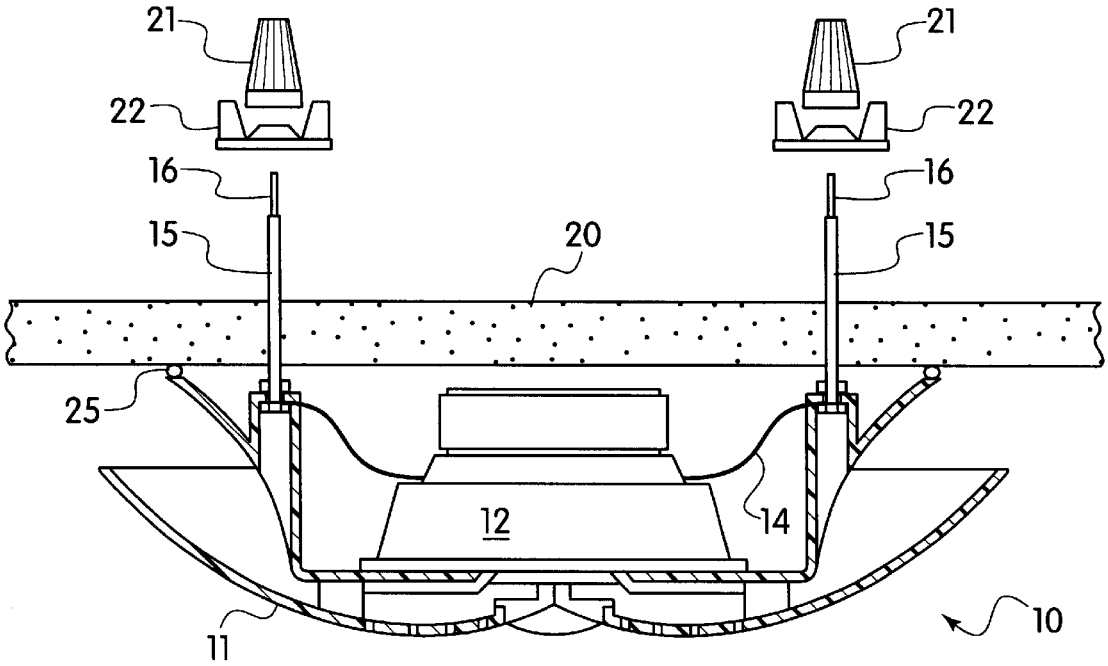
FIG. 1 shows a side cross-sectional view of the speaker mounting assembly according to the invention being inserted into a ceiling tile.
Figure 2:
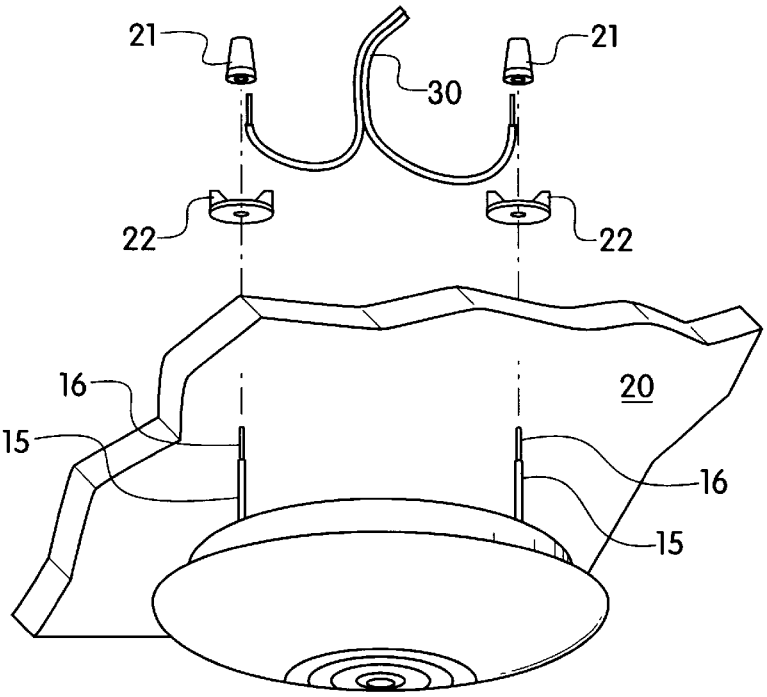
FIG. 2 shows a perspective exploded view of the assembly prior to attachment to a ceiling tile.
Figure 3:
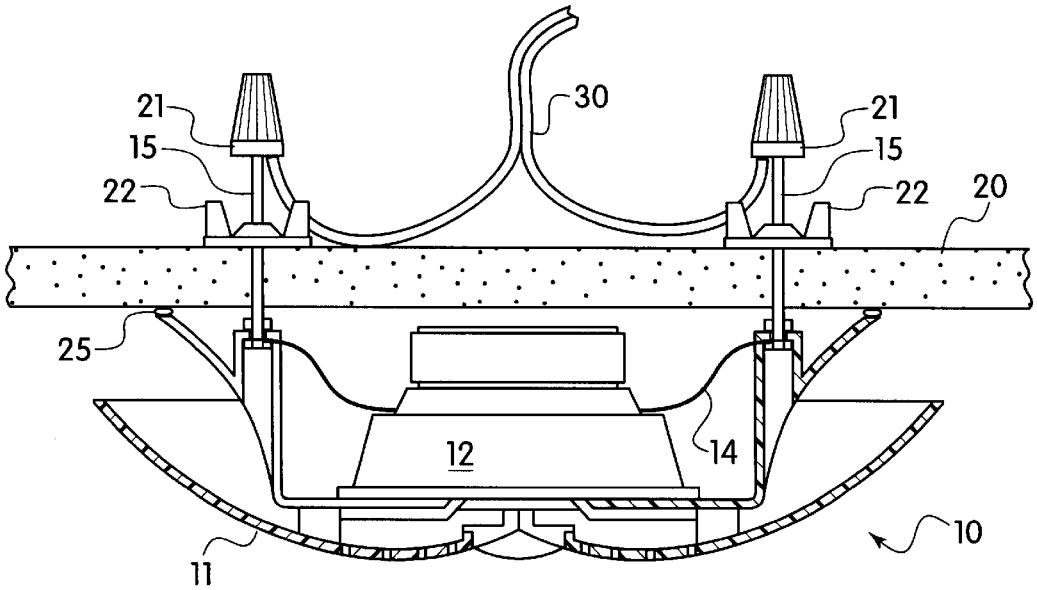
FIG. 3 shows a side cross-sectional view of the assembly after attachment to a ceiling tile.

Referring now in detail to the drawings and, in particular, FIGS. 1–3 show the speaker mounting assembly 10 according to the invention. Assembly 10 comprises a housing 11 to which a speaker 12 is attached. Housing 11 is preferably a paintable plastic, but any suitable material could be used. Two studs 15 extend upward from the interior of housing 11 to pierce a ceiling tile 20. Studs 15 are electrically connected to speaker 12 via wires 13 and 14. Studs 15 are threaded to grip ceiling tile 20 more securely, but have an unthreaded pointed tip 16, which facilitates piercing of the ceiling tile. Tip 16 also easily accepts a wire nut 21, which is used to secure amplifier wires 30 to tip 16.

Wing nuts 22 are screwed onto studs 15 to secure assembly 10 to ceiling tile 20 after installation. Wing nuts 22 are preferably wide based wing nuts that spread the tension over a large surface area, thus leading to a secure attachment of the assembly to ceiling tile 10. Wing nuts 22 are also easy to handle and install.

To create a tight seal between ceiling tile 20 and speaker housing 11, a rubber O-ring 25 is mounted around the edge of housing 11. This eliminates any whistles and ensures a smoother sound.

Preferably one stud is nickel plated and the other stud is copper plated to color code the studs. This is to identify the polarity of the studs for proper installation.

Mounting assembly 10 allows a person to mount a speaker to a ceiling tile very quickly, using no tools, and creating virtually no mess or damage.

Accordingly, while only a single embodiment of the present invention has been shown and described, it is obvious that many changes and modifications may be made thereunto without departing from the spirit and scope of the invention.

What is claimed is:

1. A speaker assembly comprising:

a speaker housing having an external surface and an internal surface;

a speaker mounted to the internal surface of the housing;

at least two threaded studs connected to the housing and extending away from the external surface of the housing, said studs being electrically connected to the speaker and having a pointed end;

at least two nuts for threading over the studs to secure the studs to a ceiling tile after the studs pierce the tile to attach the housing to the tile; and at least two wire nuts to connect amplifier wires to the tip of the studs;

wherein the studs establish an electrical connection between the amplifier wires and the speaker.

2. The assembly according to claim 1, wherein the tips of the studs are unthreaded.

3. The assembly according to claim 1, further comprising an O-ring mounted around an edge of the housing so that pressing the housing against a ceiling tile causes the O-ring to create a tight seal between the housing and ceiling tile.

4. The assembly according to claim 1, wherein the studs are not identical in appearance, to indicate polarity.

5. The assembly according to claim 4, wherein the studs are two different colors.

6. The assembly according to claim 5, wherein the studs are plated with two different metals.

7. The assembly according to claim 6, wherein one stud is nickel-plated and one stud is copper-plated.

8. The assembly according to claim 1, wherein the unthreaded tip is textured to more securely grip the wire nuts.

9. The assembly according to claim 1, wherein the nuts are wing nuts.

* * * * *